US006142847A

United States Patent [19]

Rudy

[11] Patent Number: 6,142,847

[45] Date of Patent: Nov. 7, 2000

[54] REFLECTIVE I-RAIL INTERCONNECTOR

[75] Inventor: Eric A. Rudy, Township of Philadelphia, Pa.

[73] Assignee: 90Degrees, Inc., Philadelphia, Pa.

[21] Appl. No.: 09/223,124

[22] Filed: Dec. 30, 1998

[51] Int. Cl.[7] ..... A63H 33/04

[52] U.S. Cl. ..... 446/85; 446/122; 446/128

[58] Field of Search ..... 446/85, 102, 104, 446/105, 108, 112, 114, 115, 122, 126, 128

[56] References Cited

U.S. PATENT DOCUMENTS

| | | | |
|---|---|---|---|
| D. 221,092 | 7/1971 | Daenen et al. | D21/2 |
| D. 233,542 | 11/1974 | Christiansen | D21/1 |
| D. 290,627 | 6/1987 | Dideriksen | D21/108 |
| D. 311,935 | 11/1990 | Andersen | D21/108 |
| D. 336,120 | 6/1993 | Knudsen | D4/108 |
| D. 336,666 | 6/1993 | knudsen | D21/108 |
| D. 355,452 | 2/1995 | Glynn | D21/108 |
| D. 356,124 | 3/1995 | Glynn | D21/108 |
| D. 367,898 | 3/1996 | Glynn | D21/108 |
| D. 377,377 | 1/1997 | Glynn | D21/108 |
| 656,275 | 8/1900 | Streeter | 446/122 |
| 1,281,856 | 10/1918 | Shaw . | |
| 1,985,032 | 12/1934 | Hoult | 446/85 |
| 2,020,562 | 11/1935 | Miller . | |
| 2,041,069 | 5/1936 | Jones et al. | 446/108 |
| 2,077,065 | 4/1937 | Johannes . | |
| 3,034,254 | 5/1962 | Christiansen . | |
| 3,127,175 | 3/1964 | White . | |
| 3,234,683 | 2/1966 | Christiansen . | |
| 3,242,610 | 3/1966 | Christiansen . | |
| 3,415,007 | 12/1968 | Howe . | |
| 3,545,122 | 12/1970 | Onanian . | |
| 3,597,875 | 8/1971 | Christiansen . | |
| 3,640,017 | 2/1972 | Christiansen . | |
| 3,667,153 | 6/1972 | Christiansen . | |
| 3,690,031 | 9/1972 | Shinoda . | |
| 3,791,090 | 2/1974 | Kniefel | 52/593 |
| 3,803,754 | 4/1974 | Fischer . | |
| 4,044,497 | 8/1977 | Bettens . | |
| 4,182,072 | 1/1980 | Much . | |
| 4,185,410 | 1/1980 | Kristiansen . | |
| 4,253,268 | 3/1981 | Mayr . | |
| 4,403,733 | 9/1983 | Bach et al. | 238/10 E |
| 4,726,515 | 2/1988 | Bolli et al. | 238/10 E |
| 5,049,104 | 9/1991 | Olsen | 446/104 |
| 5,061,218 | 10/1991 | Garage et al. | 446/102 |
| 5,094,643 | 3/1992 | Bolli et al. | 446/121 |
| 5,209,693 | 5/1993 | Lyman | 446/104 |
| 5,411,428 | 5/1995 | Orii et al. | 446/90 |
| 5,427,558 | 6/1995 | Knudsen et al. | 446/102 |
| 5,527,201 | 6/1996 | Maddock | 446/104 |
| 5,938,496 | 8/1999 | Zheng | 446/115 |
| 5,957,744 | 9/1999 | Mott et al. | 446/122 |

OTHER PUBLICATIONS

Lego Technic Electric Motor System 8735.

*Primary Examiner*—Sam Rimell
*Attorney, Agent, or Firm*—Kenneth P. Glynn

[57] ABSTRACT

A plurality of reflective T-rail interconnector members are adapted for use with a toy block set and establish at least one pair of adjoining T-rails, wherein the first T-rail is non-parallel to the second T-rail so as to permit multi-directional slidable interconnection with a plurality of toy block configurations that are slidably, pivotally and fixably coupled to one another and which are further capable of three dimensional slidable and pivotal maneuvering with respect to one another by virtue of rail extension members, rail guide members and pivot members. The reflective T-rails may further include coupling members or, in the alternative, the reflective T-rails may be unistructurally molded so as to establish a plurality of infinitely sized and shaped T-rails which permit multi-directional slidable interconnection with a plurality of toy block configurations.

13 Claims, 9 Drawing Sheets

REFLECTIVE I-RAIL INTERCONNECTOR

BACKGROUND OF THE INVENTION

1. Field of the Invention

The present invention relates to toy block sets and more precisely to toy block sets which include a plurality of reflective T-rail interconnector members which are adapted to be used with a plurality of toy blocks that are slidably, pivotally and fixably coupled to one another and which are further capable of three dimensional slidable and pivotal maneuvering with respect to one another by virtue of rail extension members, rail guide members and pivot members.

2. Information Disclosure Statement

The following patents describe the state of the art in toy blocks and toy block sets.

Lego® Technic presently demonstrates an electric motor system which includes a rectangular Lego® piece having a pair of symmetrical protrusions and having centrally located on one side wall an extension which includes a first thinner portion which extends longitudinally across the entire length of the side wall of the rectangular block and a second wider portion having the same height as the main body of the block.

U.S. Design Pat. No. 221,092 shows a component for a multi-pieced block which has circular recesses and also shows cut-outs opposite one another.

U.S. Design Pat. No. 233,542 shows a toy building element that includes symmetric protrusions and slotted side extensions opposite one another.

U.S. Design Pat. No. 290,627 shows a toy building element with a telescopic extension having symmetrical protrusions.

U.S. Design Pat. No. 311,935 shows a toy building element having a square base and a circular extension with symmetric protrusions.

U.S. Design Pat. No. 336,120 shows a toy building block having hour glass and semi-hourglass shaped bores and centrally located circular bores.

U.S. Design Pat. No. 336,666 shows a toy building block having rectangular bores and a central circular bore.

U.S. Design Pat. No. 355,452 shows a toy I-beam block having an extended beam located between like square blocks.

U.S. Design Pat. No. 356,124 shows a toy I-beam and block wherein the I-beam is extended outwardly from the side of the block.

U.S. Design Pat. No. 367,898 shows a toy construction block with a T-slot for allowing interconnection with T-shaped members.

U.S. Design Pat. No. 377,377 shows a toy construction block with a plurality of T-slots for allowing interconnection with T-shaped members.

U.S. Pat. No. 1,281,856 shows different toy block configurations with grooves and recesses which retain elongated rectangular fixed pieces.

U.S. Pat. No. 2,020,562 teaches a set of blocks having outer exposed surfaces which enable interlocking joinder via interlocking recesses and partial interlocking projections which enable slidable and frictional union thereof.

U.S. Pat. No. 2,077,065 shows a toy log block house configuration which has rectangular plate-like slabs for interconnection with corresponding blocks with cut-outs thereon.

U.S. Pat. No. 3,034,254 describes a toy building block including inclined side faces and symmetrical protrusions.

U.S. Pat. No. 3,127,175 shows a railroad puzzle game which includes slidable box cars which engage extension tracks such that inner edges of the track are provided with undercut grooves which correspond to extending flanges on the box cars.

U.S. Pat. No. 3,234,683 teaches a toy building element comprising a rectangular block having top, side, and end walls defining a cavity and at least one pair of projections within said cavity, an insert fitted into said cavity comprising a plate having the same outline as the internal face of the top wall of said block and on its inner face at least one pair of projections providing a clamping engagement with the projections of said block, said projections, top, and insert forming a channel within said cavity transverse to opposing walls of said block adapted to receive a bushing, and a bushing rotatably disposed within said channel, at least one of said opposing walls having an aperture therein aligned with said bushing and adapted to receive a spindle for insertion in said bushing.

U.S. Pat. No. 3,242,610 teaches a flexible interconnector for interconnecting plastic building blocks of the type having a pattern of protuberances on an outer surface thereof and means within the blocks for individually frictionally engaging with said protuberances, comprising at least two flat sheets mutually interconnected by a single, integral means comprising a member narrow but thick in relation to said sheets and sufficiently long and flexible readily to permit movement to said sheets having on one surface thereof means comprising a pattern of protuberances corresponding to at least enough of the pattern of the protuberances of the blocks with which it is to be used to be individually frictionally engaged by means within the blocks.

U.S. Pat. No. 3,415,007 shows a toy building blocks set which includes brick-like blocks elements with extended portions and central grooves for allowing inter-connection with other like blocks.

U.S. Pat. No. 3,545,122 shows various blocks having orthogonal recessed faces which may be coupled with like projections so as to permit interconnection of such blocks.

U.S. Pat. No. 3,597,875 shows toy building blocks of similar shape but constructed to different modules. They are buildable together and, to this end, the inner protrusions of the smaller blocks coact with the outer projections of the larger blocks differently from the coaction within the module.

U.S. Pat. No. 3,640,017 shows a slide-bar assembly which includes a rectangular elongated female member and an elongated male member adapted for slidable mounting within the female member. The slide-bar assembly, however, teaches slidable movement along only one axis.

U.S. Pat. No. 3,667,153 shows the coupling of two plate-shaped elements by means of an interlocking arrangement formed along the edges of the elements. The locking members of one element are in resilient engagement with identical locking members on the other element, the thickness of the element and the members being strategered alternately to one side and the other of a plane through the center of the edge parallel to the side faces of the element.

U.S. Pat. No. 3,690,031 teaches a toy block set wherein all of the blocks have the same configuration and dimensions and wherein each of said blocks includes rectilinear guide grooves which serve as tracks for guiding a toy vehicle thereupon.

U.S. Pat. No. 3,791,090 teaches toy building blocks having dovetail tongue and groove configurations for interlocking with adjacent blocks by sliding in a longitudinal direction to achieve connection.

U.S. Pat. No. 3,803,754 teaches an assembly kit which comprises a plurality of prismatic building blocks each having at least one face portion provided with a narrow elongated slit being a rectilinear non-circular cross-sectional outline. A plurality of connecting elements are provided, and each comprises a pair of connecting portions complimentary to said slits and having transversely established portions which are resiliently deformed upon insertion into the slits of registering blocks.

U.S. Pat. No. 4,044,497 shows a construction kit that comprises male and female elements, preferably of molded plastic material, for assembly into various model structures. The male elements have cubic bodies with studs protruding from two or more faces and the female elements are elongated U-section pieces having corresponding square end walls with keyhole-shaped openings for receiving and gripping shanks of the studs whose heads are guided and held between the lateral walls of the female elements. The male elements can be formed interengaging pieces, and may possibly be pivotally joined.

U.S. Pat. No. 4,182,072 teaches a toy construction kit is provided which includes, as basic building elements, a plurality of interlockable plate members, each plate member having a tongue along one side and a groove along the other side whereby two or more plate members can be connected together in a tongue and groove fashion to form a composite structural member with the preferred composite structural member being a hollow polyhedron such as a right rectangular prism. The plate members have apertures for receiving dowel members which have a slot extending along their length so that each dowel member may be force-inserted into one of the apertures for being compressively retained therein. The dowel members also have keyhole-shaped apertures on each end for receiving flat panel members and lock pins. Disc-shaped hubs, wheels and angle blocks are provided for being carried by the dowel members. The angle blocks are provided with projecting pins for being received in the apertures of the plate members. The angle blocks further have a central aperture for receiving a dowel member and have a keyhole-shaped aperture in each projecting pin. The lock pin may be received in the keyhole-shaped aperture of the dowel members.

U.S. Pat. No. 4,185,410 shows a suspension device for slidable and pivotal suspension of a base plate for toy building sets or base boards for visual planning panels. One face of the base plate or board is provided with rows of coupling studs including a plurality of studs informally spaced apart in both longitudinal and transverse directions, and the suspension device includes a gripping member having inwardly projecting guides adapted to slide along the base plate between a pair of rows of projections and to support the base plate when suspended on a wall. The device is further provided with a hinge member pivotally mounted on top of the gripping member, so as to provide for pivotal movements of the base plate which is mounted by means of the slidable suspension device.

U.S. Pat. No. 4,253,268 teaches a toy building block set that has flat plate elements of semi-elastic plastic materials that interlock with pressure inserted ball socket joints. The flat plates may have various geometric shapes such as triangles, squares, etc., with each side the same length and having identical mating ball and joint locking elements. Along each block side mid-spaced between the center and two corners are respectively a ball and socket. Means are provided for mounting shafts through holes in the plates.

U.S. Pat. No. 4,403,733 shows a track for toy trains that is made by detachably connecting a plurality of rail elements having lengthwise extending rail-forming ribs with tie elements provided with connecting members which are adapted to be clamped into cavities in the bottom of the rails adjacent the end thereof, so as to provide a sort of snap-locking device, including: in the rails: a lengthwise extending cavity in the bottom of the rails defined by side walls and end walls. In the bottom of the cavity adjacent the end walls there is provided an aperture which communicates with another aperture extending transversely through the rib on the top face of the rail, and in ties; pairs of upwardly extending spring clips interspaced at a distance corresponding to the gauge of the track and having a socket fitting into the cavity of the rails, a pair of upwardly extending, resiliently deformable tongues provided with outwardly projecting flanges, the lower faces of which are adapted to engage the upper face of the rails, when sockets are plugged into the cavities of the rails.

U.S. Pat. No. 4,726,515 shows a track system for toy vehicles that contains straight and curved track pieces at the end of which are reference points of a track grid having a track module which is a multiple of the building module.

U.S. Pat. No. 5,049,104 shows a connecting system for a toy building set comprises a first coupling part and a second coupling part, which are provided on their respective ones of a pair of building elements, adapted to be interconnected, and are formed with respective complimentary coupling elements. The coupling parts in the connecting elements of the invention are adapted to interconnect the elements by elastic movement of at least one coupling part. The interconnection is flexible and may be fixed with a clamping device, which blocks the elastic movement.

U.S. Pat. No. 5,061,218 shows toy building blocks capable of assembly in any selected one of a variety of arrangements of contiguous blocks which include a plurality of projections on one face of each block and a plurality of longitudinal and lateral channels on an opposite face of the block, the relative dimensions of the projections and the channels being such that the projections of one block are received in the channels of contiguous block in the selected arrangement for sliding engagement in longitudinal and lateral directions while the projections are engaged with the channel for enabling alterations in the arrangement of contiguous blocks as the assembly is constructed.

U.S. Pat. No. 5,094,643 teaches a toy set connection device which consists of two bushing parts which are fixedly mountable on the shaft. By means of an axial or rotational displacement of the second bushing part relative to the first bushing part, the whole shaft bushing can be anchored in a desired transverse groove on shaft. The anchoring may be released by pulling the second bushing apart from the first part.

U.S. Pat. No. 5,209,693 teaches toy building blocks of the type having an array of sockets on one principal face and a matching array of projections on the opposite face that can be wedged into the sockets of another block are also joinable in an end to end relationship which enables lateral pivoting of one block in either direction relative to the block with which it is linked. In the preferred form, the opposite ends of the blocks are linkable to still other blocks in a manner which enables pivoting or flexing in an orthogonal direction. This enables assembly of interlocking blocks into a greater variety of different constructions and enables pivoting of linked portions of an assembled construction in a greater number of different directions.

U.S. Pat. No. 5,411,428 shows a block unit for a toy block that contains a block body having protrusions and recesses through which the block body is freely connectable to other block units. A rotary shaft is rotatably supported in the block body in such manner that the rotary shaft is extended in a block coupling direction in which the block unit is coupled to the other block units through the protrusions and recesses thereof. The block unit may include a drive source such as an electric motor mounted therein.

U.S. Pat. No. 5,427,558 teaches a toy building set element which is formed of a first part which is slidable and resiliently journaled with respect to the first part. Both of the parts have coupling elements thereon which permit coupling of the parts to the other elements of the toy building set. One of the parts may be adapted to receive a shaft through a cylindrical opening that runs perpendicular to the displacement direction of the parts with respect to each other.

U.S. Pat. No. 5,527,201 shows toy building pieces which may be advantageously used in conjunction with POPSICLE sticks, or their generic equivalents, or other framing pieces or connectors. One or more faces of many of the building pieces' apertures are defined in the surface thereof to receive a framing piece such as a POPSICLE stick or connectors which are I-shaped in cross-section.

None of the prior art examples show or teach a plurality of reflective T-rail interconnector members that are coupled to toy blocks which are slidably, pivotally and fixably coupled to one another and which are further capable of three dimensional slidable and pivotal maneuvering with respect to one another as taught by the present invention.

SUMMARY OF THE INVENTION

A plurality of reflective T-rail interconnector members are adapted for use with a toy block set and establish at least one pair of adjoining T-rails, wherein the first T-rail is non-parallel to the second T-rail so as to permit multi-directional slidable interconnection with a plurality of toy block configurations that are slidably, pivotally and fixably coupled to one another and which are further capable of three dimensional slidable and pivotal maneuvering with respect to one another by virtue of rail extension members, rail guide members and pivot members. The reflective T-rails may further include coupling members or, in the alternative, the reflective T-rails may be unistructurally molded so as to establish a plurality of infinitely sized and shaped elongated T-rails which permit multi-directional slidable interconnection with a plurality of toy block configurations.

BRIEF DESCRIPTION OF THE DRAWINGS

The present invention should be more fully understood when the specification herein is taken in conjunction with the drawings appended thereto, wherein.

DETAILED DESCRIPTION OF THE PRESENT INVENTION

The present invention includes a plurality of reflective T-rail interconnector members which are adapted for use with a toy block set and which establish at least one pair of adjoining T-rails, wherein the first T-rail is non-parallel to the second T-rail so as to permit multi-directional slidable interconnection with a plurality of toy block configurations that are slidably, pivotally and fixably coupled to one another and which are further capable of three dimensional slidable and pivotal maneuvering with respect to one another by virtue of rail extension members, rail guide members and pivot members. The reflective T-rails may further include coupling members or, in the alternative, the reflective T-rails may be unistructurally molded so as to establish a plurality of infinitely sized and shaped elongated T-rails which permit multi-directional slidable, axial interconnection with a plurality of toy block configurations.

The present invention reflective T-rail interconnector members may be constructed out of any suitable material known to be used in the art and may likewise encompass any size, shape and dimension. The shape and dimension of present invention reflective T-rail interconnector members may permit frictional or non-frictional slidable axial interconnection. It is one object of the present invention to provide a plurality of reflective T-rail interconnector members which may be combined with a set of toy blocks which are slidably, pivotally and fixably coupled to one another and which are further capable of three dimensional slidable and pivotal maneuvering with respect to one another by virtue of rail extension members, rail guide members and pivot members and which set may also include conventional toy blocks, such as Lego® blocks and other like blocks, so as to create a new interconnection profile. It is also an object of the present invention to create an independent set of reflective T-rail interconnector members which may be combined in any variety of ways to establish a multitude of assembled formations which, when constructed, allow a user to move and slide individual reflective T-rail interconnector members in such a manner so as to provoke three dimensional slidable and pivotal relative motion therebetween. A better understanding of the present invention will be achieved by reference to all of the Figures described herein below.

Figure 1:
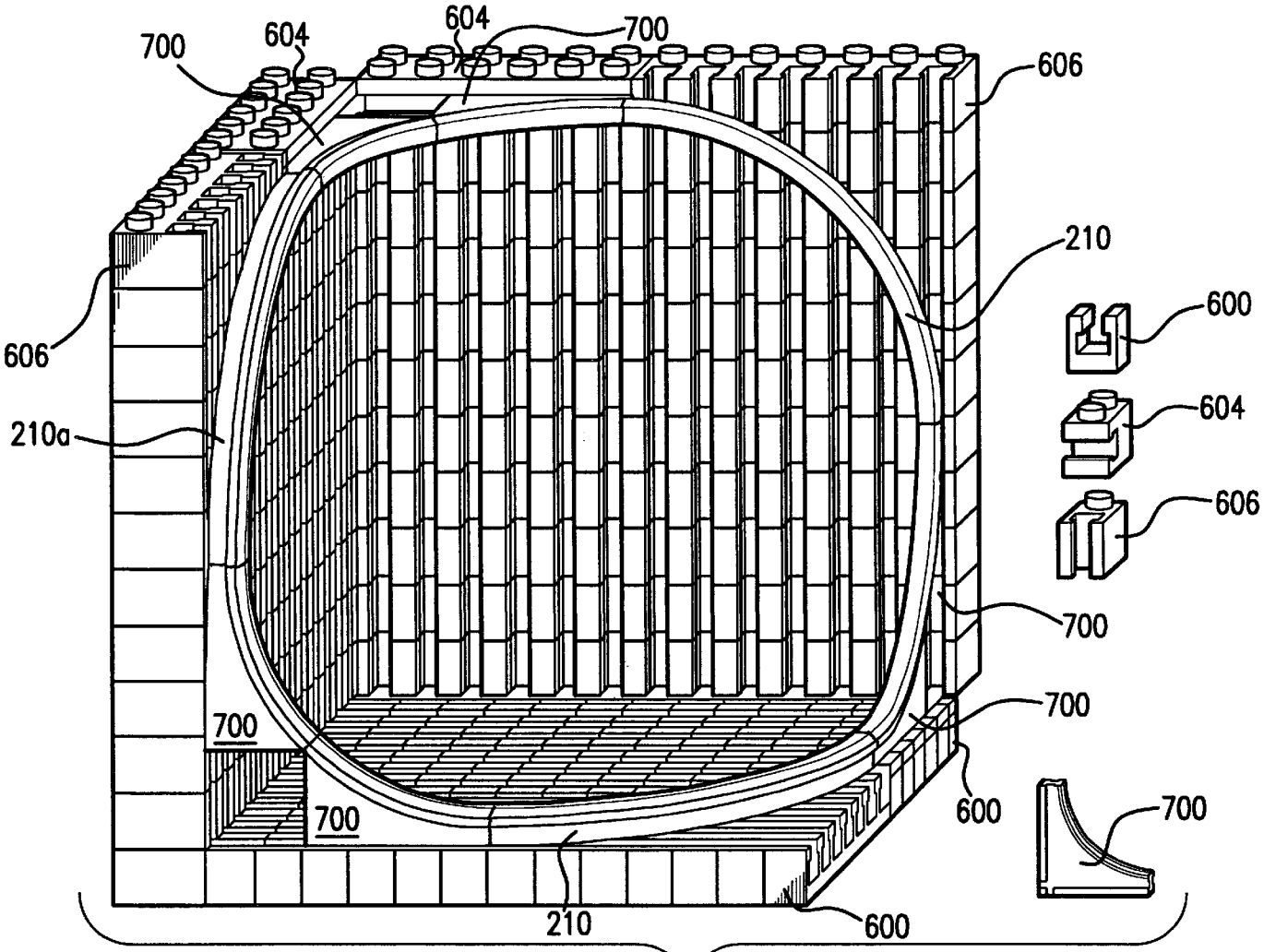
FIG. 1 shows a landscape view of an assembled arrangement of present invention reflective T-rail interconnector members which are interconnected with toy blocks and further shows details of the three dimensional movable and slidable capabilities thereof.
Figure 2:
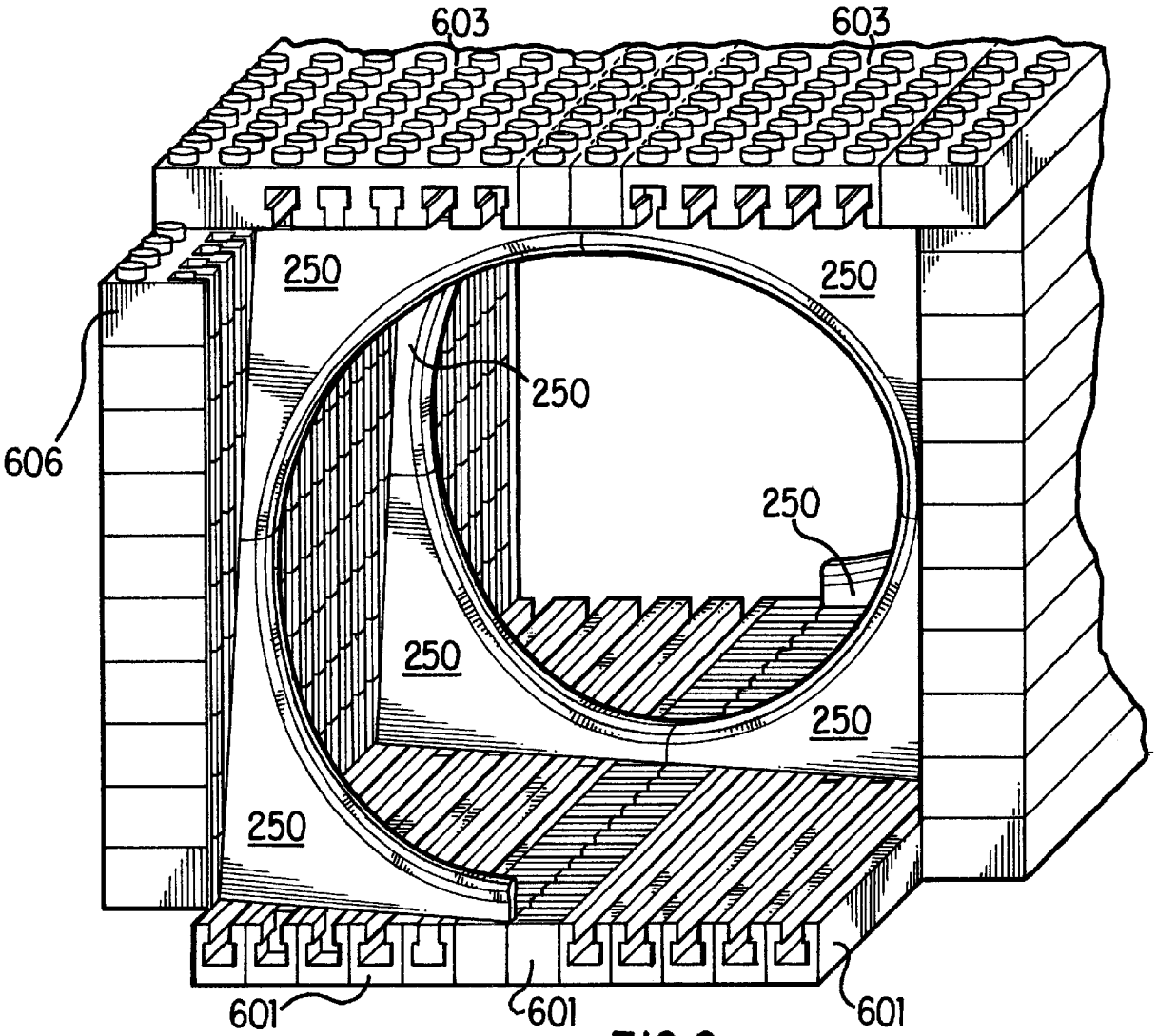
FIG. 2 shows a landscape view of another assembled arrangement of present invention reflective T-rail interconnector members which are interconnected with toy blocks and further shows details of the three dimensional movable and slidable capabilities thereof.

FIG. 1 shows a landscape view of an assembled assembled arrangement of present invention reflective T-rail interconnector members which are interconnected with toy blocks and further shows details of the three dimensional movable and slidable capabilities thereof. FIG. 2 shows a landscape view of another assembled arrangement of present invention reflective T-rail interconnector members which are interconnected with toy blocks and further shows details of the three dimensional movable and slidable capabilities thereof. A more thorough conception of the present invention set of toy blocks, as demonstrated by FIGS. 1 and 2, will be achieved by viewing FIGS. 3 through 27 in conjunction therewith.

Figure 3:
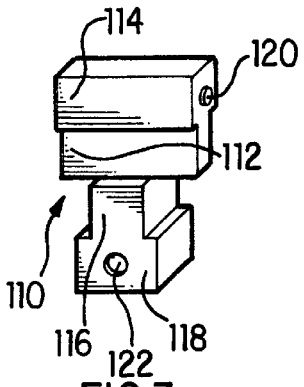
FIGS. 3, 4, and 5 show a perspective view, a top view and a bottom view respectively of a present invention reflective T-rail interconnector member having coupling means thereon.
Figure 4:
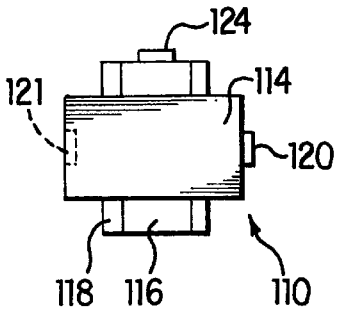
Figure 5:
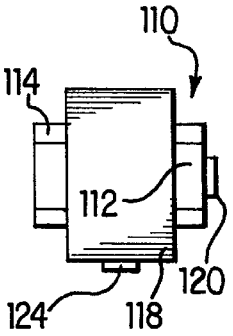

FIGS. 3, 4, and 5 show a perspective view, a top view and a bottom view respectively of a present invention reflective T-rail interconnector member having coupling means thereon. As shown here, reflective T-rail interconnector member 110 includes an upper T-shaped T-rail which is defined by first segment 112 and second segment 114 which includes annular protrusion 120 thereon, which serves as a coupling member so as to permit attachment of reflective T-rail interconnector member 110 with other like interconnector members. An annular impression 121 may be included opposite protrusion 120 if desired. The lower inverted T-shaped T-rail of reflective T-rail interconnector member 110 is defined by first segment 116 and second segment 118 which includes annular impression 122 thereon. The upper and lower T-rails are shown here as being perpendicularly extending rail members, however, as is described in more detail below, any reflective profile may be employed without exceeding the scope of the present invention.

Figure 6:
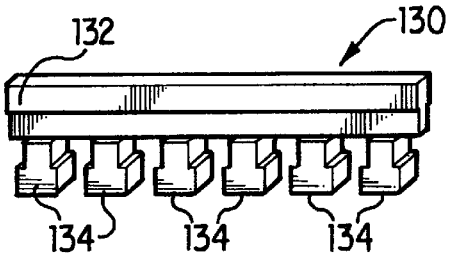
FIGS. 6 and 7 show a perspective view and a top view respectively of a present invention reflective T-rail interconnector member having a single upper T-rail and a plurality of reflective lower T-rails which are perpendicular to the upper T rail and which are parallel to one another.
Figure 7:
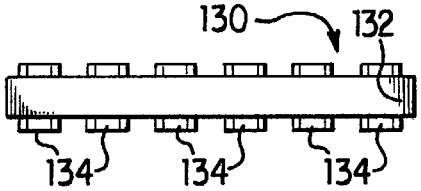

Referring to FIGS. 6 and 7, reflective T-rail interconnector member 130 includes elongated upper T-rail 132 and includes a plurality of lower T-rail members 134 which are shown as being perpendicular to elongated upper T-rail 132 and parallel to one another. Thus, reflective T-rail interconnector member 130 permits slidable motion along two axes.

Figure 8:
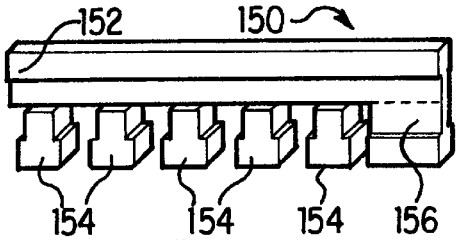
FIGS. 8 and 9 show a perspective view and a top view respectively of a present invention reflective T-rail interconnector member having a single upper T-rail and a plurality of reflective lower T-rails which are perpendicular to the upper T-rail and which are parallel to one another and having one lower T-rail which is parallel to the upper T-rail and which is nonparallel to the other lower T-rails.
Figure 9:
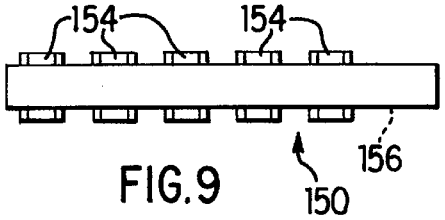

Referring to FIGS. 8 and 9, reflective T-rail interconnector member 150 includes elongated upper T-rail 152 and includes a plurality of reflective perpendicular lower T-rails 154 and includes a single lower T-rail member 156 which extends parallel to upper T-rail 152. It is to be understood that upper and lower T-rails may be pivotally attached to one another so as to permit relative pivoting of the same about an axis. For instance, lower T-rail 156 may be pivotally attached to upper T-rail 152 so as to enable lower T-rail 156 to pivot from a parallel position to a non-parallel position without exceeding the scope of the present invention.

Figure 10:
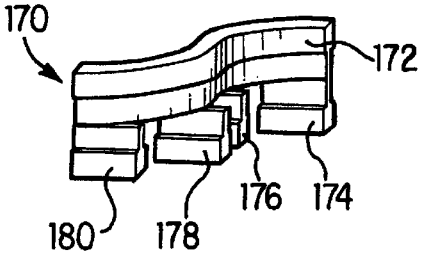
FIGS. 10 and 11 show a perspective view and a top view respectively of a present invention reflective T-rail interconnector member having an S-shaped single upper T-rail and a plurality of reflective lower T-rails which are non-parallel to the upper S-shaped T-rail and which are parallel to one another.
Figure 11:
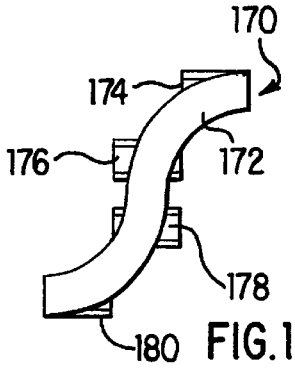

Referring to FIGS. 10 and 11, reflective T-rail interconnector member 170 includes S-shaped upper T-rail 172 and includes a plurality of lower reflective T-rails 174, 176, 178, and 180 which are non-parallel to S-shaped upper T-rail 172 and which are parallel to one another.

Figure 12:
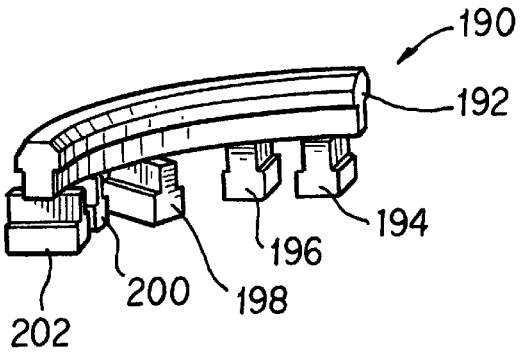
FIGS. 12 and 13 show a perspective view and a top view respectively of a present invention reflective T-rail interconnector member having a curve-shaped single upper T-rail and a plurality of reflective lower T-rails which are non-parallel to the upper curve-shaped T-rail and which are generally non-parallel to one another.
Figure 13:
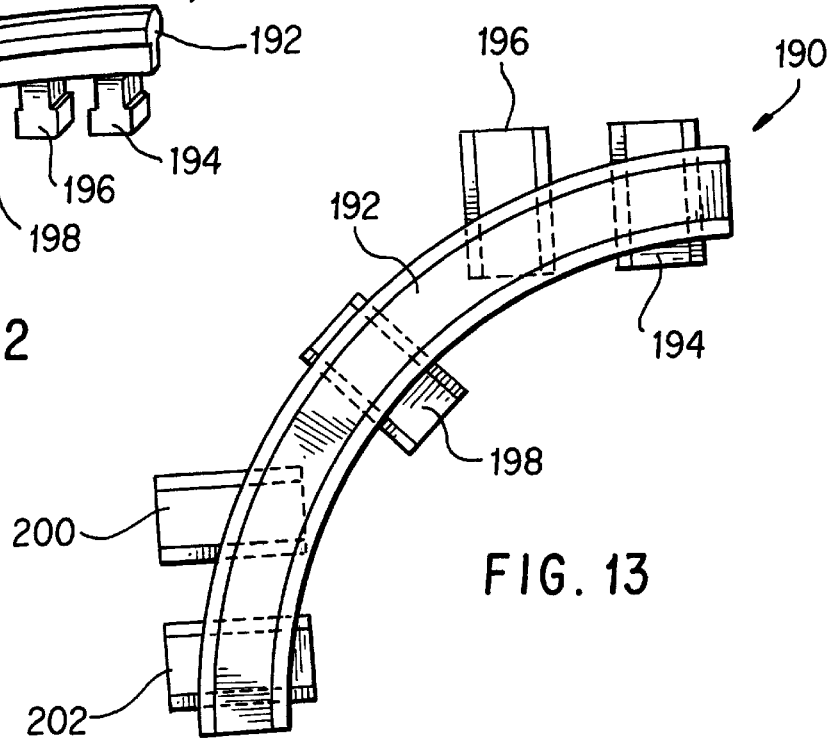

Referring to FIGS. 12 and 13, reflective T-rail interconnector member 190 includes curved upper T-rail 192 which, as shown here, is defined in the shape of a C. A plurality of lower reflective T-rails are included such that reflective lower T-rail members 194 and 196 are parallel to one another and non-parallel to curve shaped upper T-rail 192. Likewise, reflective lower T-rail members 200 and 202 are parallel to one another and are non-parallel to upper curved T-rail member 192 and reflective lower T-rail members 194 and 196. Lower T-rail member 198 is generally perpendicular to a portion of upper curved T-rail 192 and is non-parallel to lower T-rail members 194, 196, 200, and 202. It should be noted that upper curved T-rail member 192 includes opposed tapered sides to permit, for instance, an adequately sized and shaped wheel or like vehicle part to traverse thereabout. In the alternative, tapers may be substituted by a rack of teeth or any other suitable formation so as to permit an infinite number and style of wheel or vehicle connector to travel thereabout. Thus, it is to be understood that all of the reflective T-rail interconnector members described herein may serve as rails for trains, cars, mono-rail vehicles, trucks, boats, planes and any other vehicle which is adapted for use with either a single elongated rail formation or, for example, an elongated side by side rail formation, such as a formation used for trains and the like.

Figure 14:
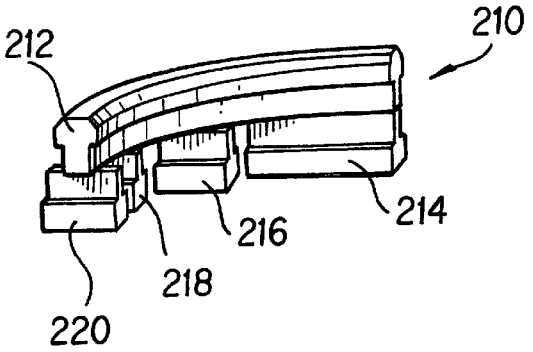
FIGS. 14 and 15 show a perspective view and a top view respectively of a present invention reflective T-rail interconnector member having a curve-shaped single upper T-rail and a plurality of reflective lower T-rails which are non-parallel to the upper curve-shaped T-rail and which are parallel to one another.
Figure 15:
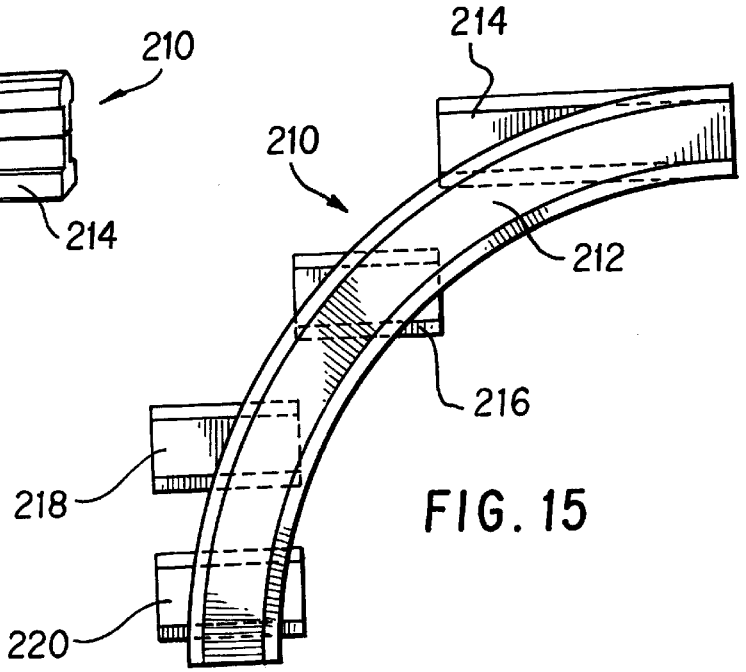

Referring to FIGS. 14 and 15, reflective T-rail interconnector member 210 includes C-shaped upper T-rail 212 and a plurality of lower reflective T-rails 214, 216, 218, and 220 which are parallel to one another and which are non parallel to C-shaped upper T-rail 212.

Figure 16:
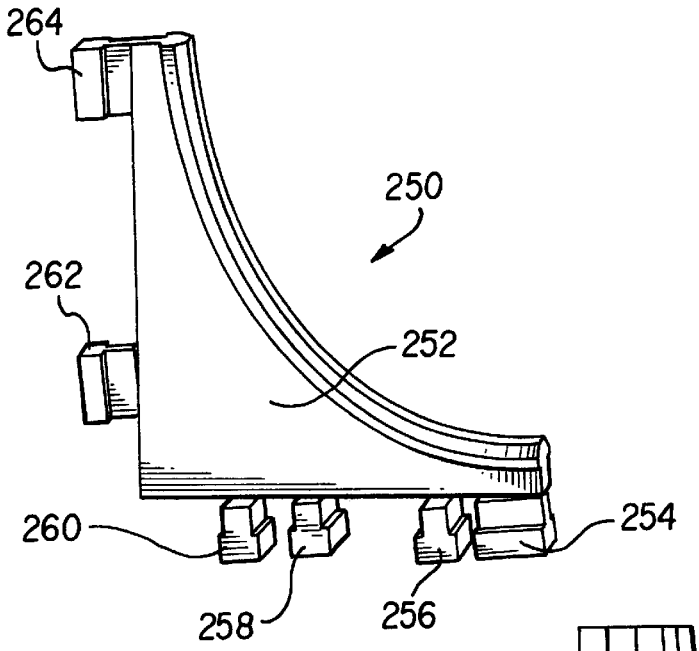
FIGS. 16 and 17 show a corkscrew-like perspective view and a side view respectively of a present invention reflective T-rail ramp interconnector member having an elongated ramp-shaped single upper T-rail and a plurality of reflective lower T-rails which are non-parallel to the elongated ramp-shaped upper T-rail and which are non-parallel to one another.
Figure 17:
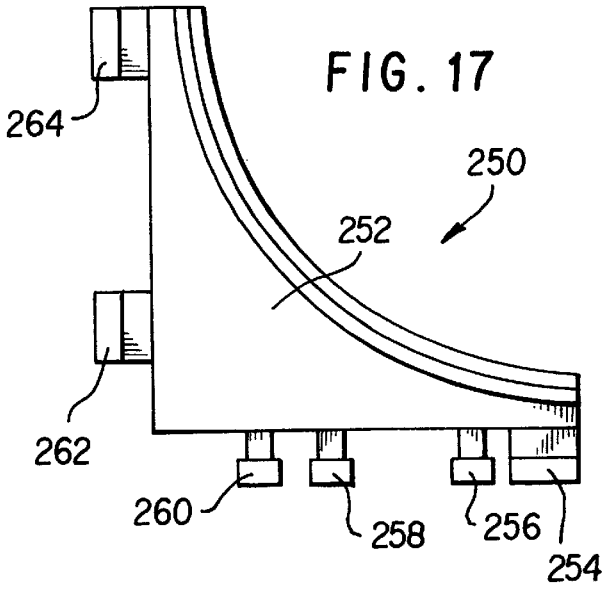

Referring to FIGS. 16 and 17, corkscrew-like, ramp-shaped reflective T-rail interconnector member 250 includes triangularly-shaped, elongated upper T-rail 252 which generates a multi-dimensional ramp rail which permits continuous multi-dimensional motion and which further encompasses a corkscrew-like twist when joined end to end with other reflective ramp-shaped T-rail interconnector members 250. Triangularly-shaped, elongated upper T-rail 252 has a first set of non-parallel reflective lower T-rails 254, 256, 258, and 260 and a second set of non-parallel T-rails 262 and 264 as shown.

Referring now to FIGS. 16 and 17, and also generally referring to FIG. 2, ramp-shaped reflective T-rail interconnector member 250 has adequate shape, size, and dimension to permit a user to establish an elongated corkscrew-shaped track as disclosed by FIG. 2. Thus, it should be further understood that reflective ramp-shaped T-rail interconnector member 250 may include an infinite degree of corkscrew-curvature thereby permitting a user to create an infinite number of corkscrew-shaped rail embodiments wherein an elongated corkscrew-shaped continuous track is established as shown for generally illustrative purposes by FIG. 2. It should be understood further that reflective ramp-shaped T-rail interconnector member 250 may include an infinite degree of corkscrew-curvature without exceeding the scope of the present invention.

Figure 18:
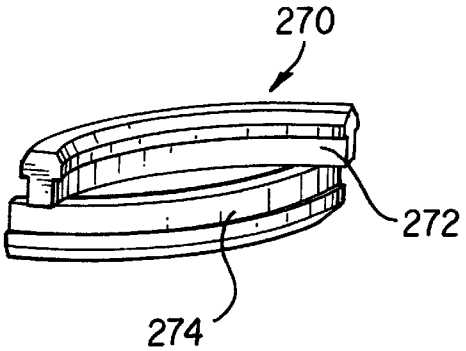
FIGS. 18 and 19 show a perspective view and a top view respectively of a present invention reflective T-rail interconnector member having a curve-shaped single upper T-rail and a curve-shaped single lower T-rail.
Figure 19:
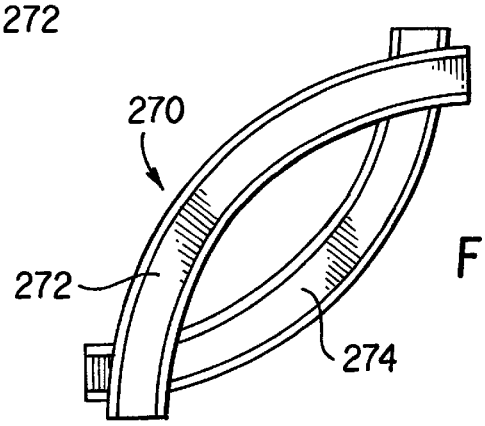

Referring to FIGS. 18 and 19, reflective T-rail interconnector member 270 includes C-shaped upper T-rail member 272 and reflective C-shaped lower T-rail 274 as shown.

Figure 20:
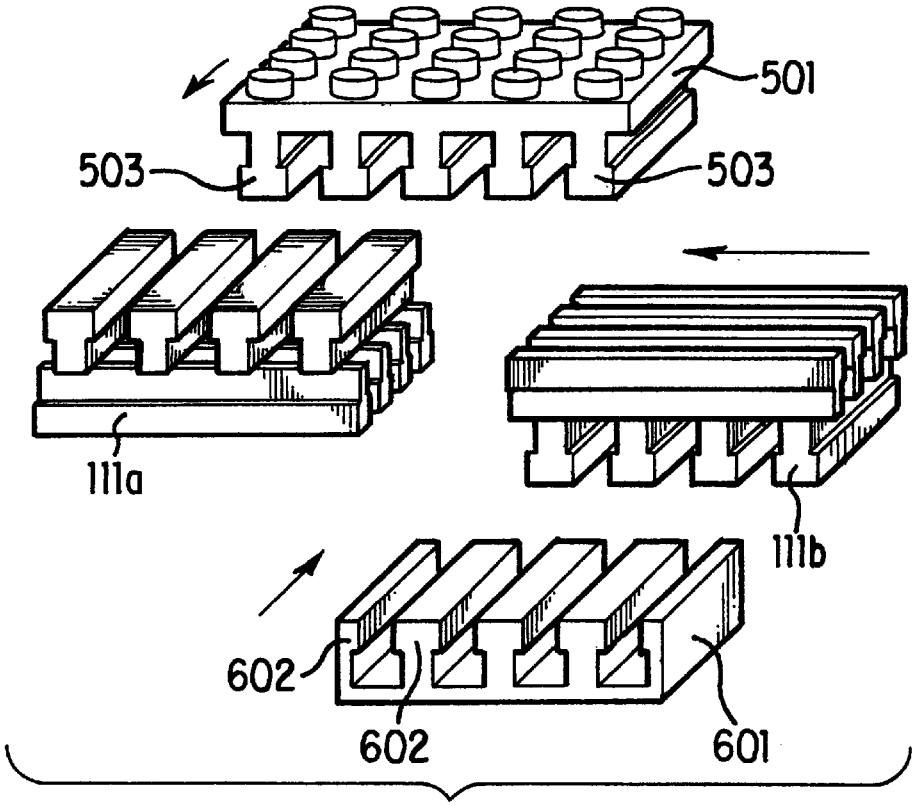
FIG. 20 shows a pair of unistructurally molded reflective T-rail interconnector members which have a plurality of upper T-rails and a plurality of lower T-rails, further demonstrating the slidable interconnectability of the pair of unistructurally molded reflective T-rail interconnector members with two unistructurally molded toy block units.
Figure 21:
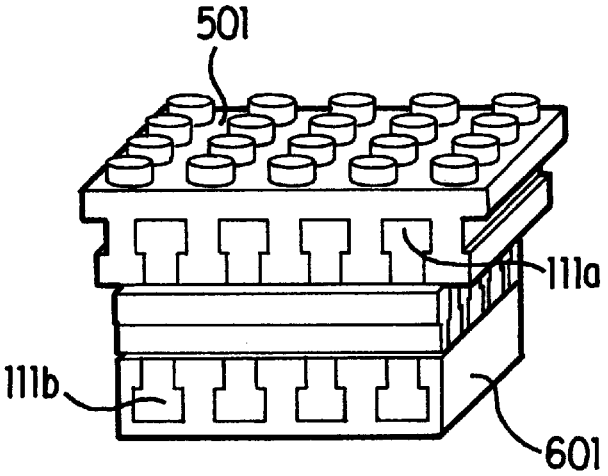
FIG. 21 shows an assembled arrangement of the disclosure shown in FIG. 20.

FIG. 20 shows a pair of unistructurally molded reflective T-rail interconnector members which have a plurality of elongated upper T-rails and a plurality of elongated reflective lower T-rails, further demonstrating the slidable interconnectability of the pair of unistructurally molded reflective T-rail interconnector members with two unistructurally molded toy block units. FIG. 21 shows an assembled arrangement of the disclosure shown in FIG. 20. As shown in FIGS. 20 and 21, toy block unit 501 includes a plurality of lower rail extension members 503 which extend downwardly so as to establish a plurality of elongated parallel rails which enable relative slidable axial movement of toy block 501 along the plurality of elongated upper T-rails of unistructurally molded reflective multi-T-rail interconnector member 111*a*. Toy block unit 601, which is a unistructurally molded unit of blocks indicative of toy block 600 shown in FIG. 1, includes a plurality of upwardly extended rail guide members 602 which establish a plurality of elongated parallel rail guidewalls which thereby enable relative slidable axial movement of toy block 601 with respect to the plurality of lower T-rails of unistructurally molded reflective multi-T-rail interconnector member 111*b*. Likewise, unistructurally molded reflective multi-T-rail interconnector members 111*a* and 111*b* are capable of slidable, relative axial motion across one another as shown, thereby generating intricate multi-dimensional simultaneous relative motion between toy blocks and reflective T-rail interconnector members. While FIGS. 20 and 21 demonstrate relative motion profiles between present invention reflective T-rail interconnector members and toy blocks, the arrows are provided for illustrative purposes only and are provided to further enhance the portrayal of relative motion and should not be construed to be either a limiting factor or an enhancing factor in terms of the scope of the present invention. Particular note, however, should be made of FIGS. 20 and 21 wherein each of those Figures demonstrates slidable interconnection and relative motion between like T-rail interconnector members. Thus, it is to be understood that any of the present invention reflective T-rail interconnector members are capable of not only interconnection with toy blocks but also with other present invention reflective T-rail interconnector members.

Figure 22:
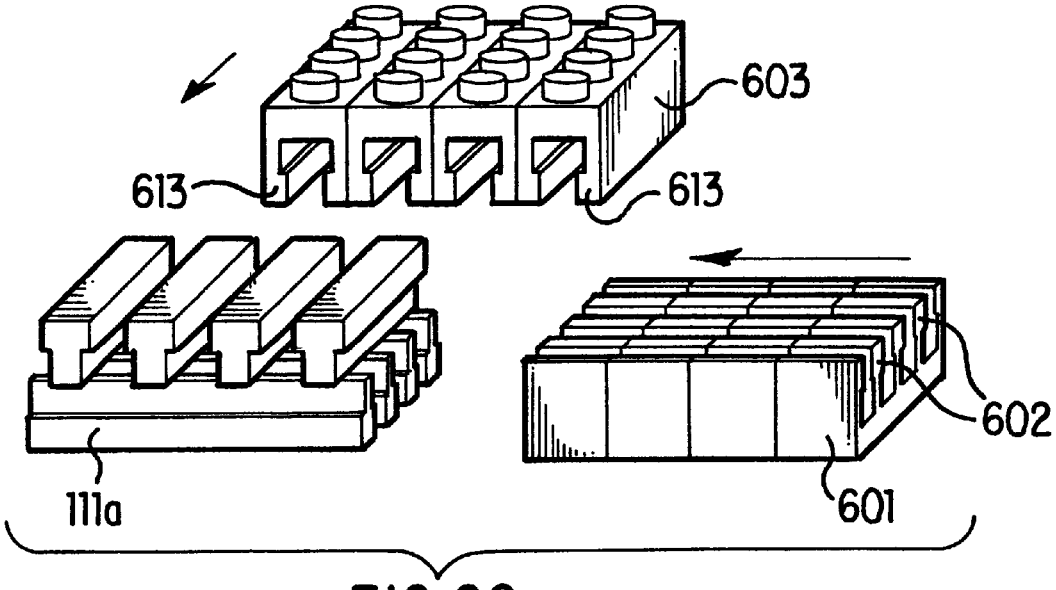
FIG. 22 shows a unistructurally molded reflective T-rail interconnector member which has a plurality of upper T-rails and a plurality of lower T-rails, further demonstrating the slidable interconnectability of the unistructurally molded reflective T-rail interconnector member with two unistructurally molded toy block units.
Figure 23:
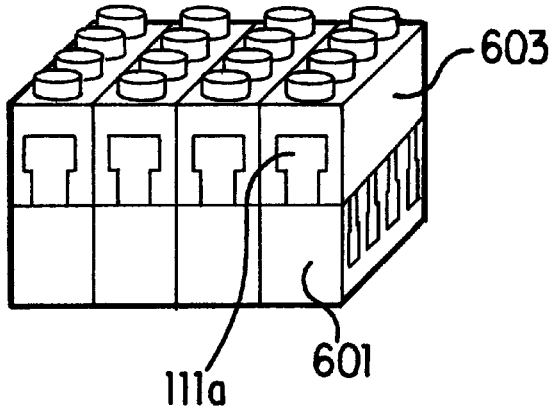
FIG. 23 shows an assembled arrangement of the disclosure shown in FIG. 22.

FIG. 22 shows a unistructurally molded reflective T-rail interconnector member which has a plurality of upper T-rails and a plurality of lower T-rails, further demonstrating the slidable interconnectability of the unistructurally molded reflective T-rail interconnector member with two unistructurally molded toy block units. FIG. 23 shows an assembled arrangement of the disclosure shown in FIG. 22. As shown in FIGS. 22 and 23, toy block unit 603 includes a plurality of downwardly extended rail guide members 613 which establish a plurality of elongated parallel rail guidewalls which enable relative slidable axial movement of toy block unit 603 along the plurality of upper T-rails of unistructurally molded reflective multi-T-rail interconnector member 111*a*. Toy block unit 601 includes a plurality of upwardly extended rail guide members 602 which establish a plurality of elongated parallel rail guidewalls which enable relative slidable axial movement of toy block 601 along the plurality of lower T-rails of unistructurally molded reflective multi-T-rail interconnector member 111*a*, thereby generating intricate multi-dimensional simultaneous relative motion between toy blocks 601 and 603 and reflective T-rail interconnector member 111*a*. While FIGS. 22 and 23 demonstrate relative motion profiles between a present invention reflective T-rail interconnector member and toy blocks, the arrows are provided for illustrative purposes only and are provided to further enhance the portrayal of relative motion and should not be construed to be either a limiting factor or an enhancing factor in terms of the scope of the present invention.

Figure 24:
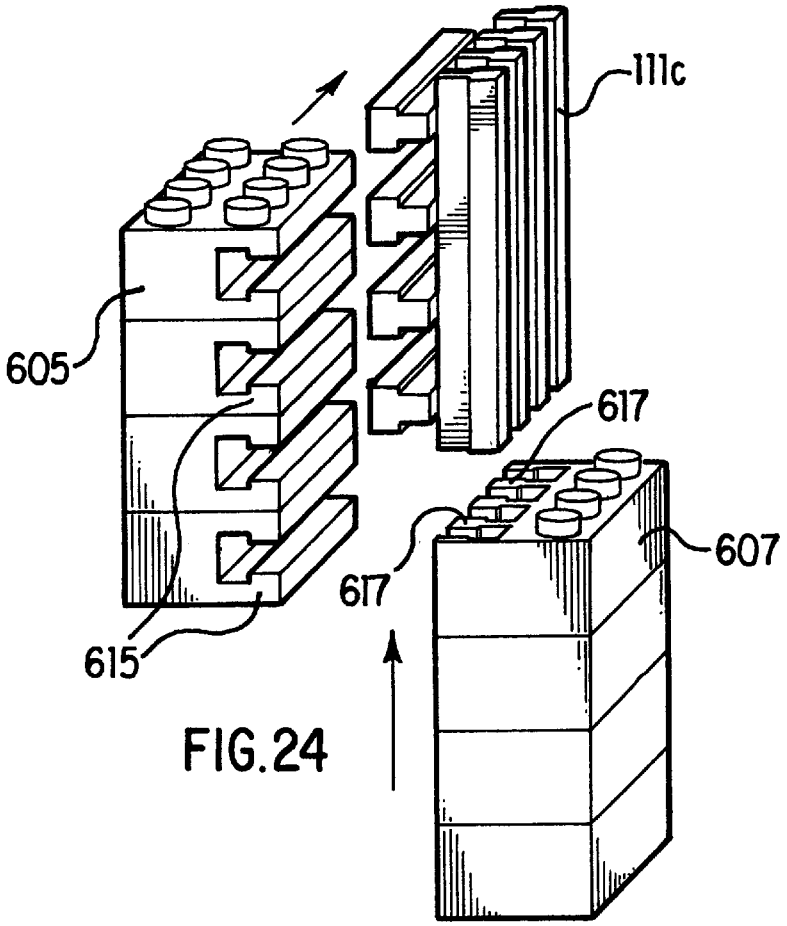
FIG. 24 shows a unistructurally molded reflective T-rail interconnector member which has a plurality of upper T-rails and a plurality of lower T-rails, further demonstrating the slidable interconnectability of the unistructurally molded reflective T-rail interconnector member with two unistructurally molded toy block units.
Figure 25:
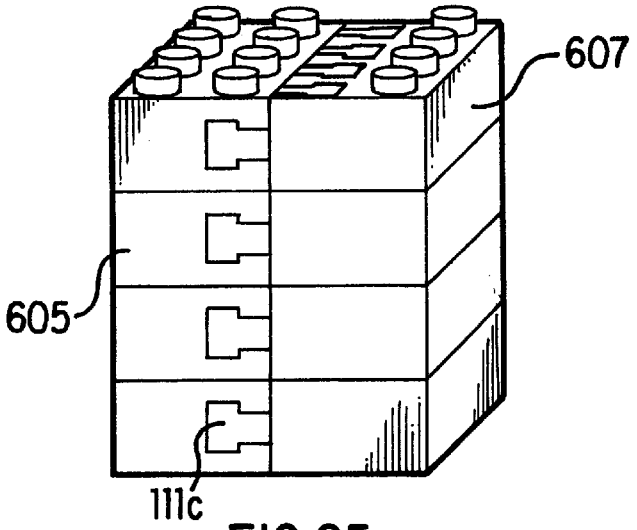
FIG. 25 shows an assembled arrangement of the disclosure shown in FIG. 24.

FIG. 24 shows a unistructurally molded reflective T-rail interconnector member which has a plurality of upper T-rails and a plurality of lower T-rails, further demonstrating the slidable interconnectability of the unistructurally molded reflective T-rail interconnector member with two unistructurally molded toy block units. FIG. 25 shows an assembled arrangement of the disclosure shown in FIG. 24. As shown in FIGS. 24 and 25, toy block unit 605, which is a unistructurally molded unit of blocks indicative of toy block 604 shown in FIG. 1, includes a plurality of sidewardly extended rail guide members 615 which establish a plurality of elongated parallel rail guidewalls which enable relative slidable axial movement of toy block unit 605 along the plurality of upper T-rails of unistructurally molded reflective multi-T-rail interconnector member 111*c*. Toy block unit 607, which is a unistructurally molded unit of blocks indicative of toy block 606 shown in FIG. 1, includes a plurality of sidewardly extended rail guide members 617 which establish a plurality of elongated parallel rail guidewalls which enable relative slidable axial movement of toy block 607 along the plurality of lower T-rails of unistructurally molded reflective multi-T-rail interconnector member 111*c*, thereby generating intricate multi-dimensional simultaneous relative motion between toy blocks 605 and 607 and reflective T-rail interconnector member 111*c*. While FIGS. 24 and 25 demonstrate relative motion profiles between a present invention reflective T-rail interconnector member and toy blocks, the arrows are provided for illustrative purposes only and are provided to further enhance the portrayal of relative motion and should not be construed to be either a limiting factor or an enhancing factor in terms of the scope of the present invention.

Figure 26:
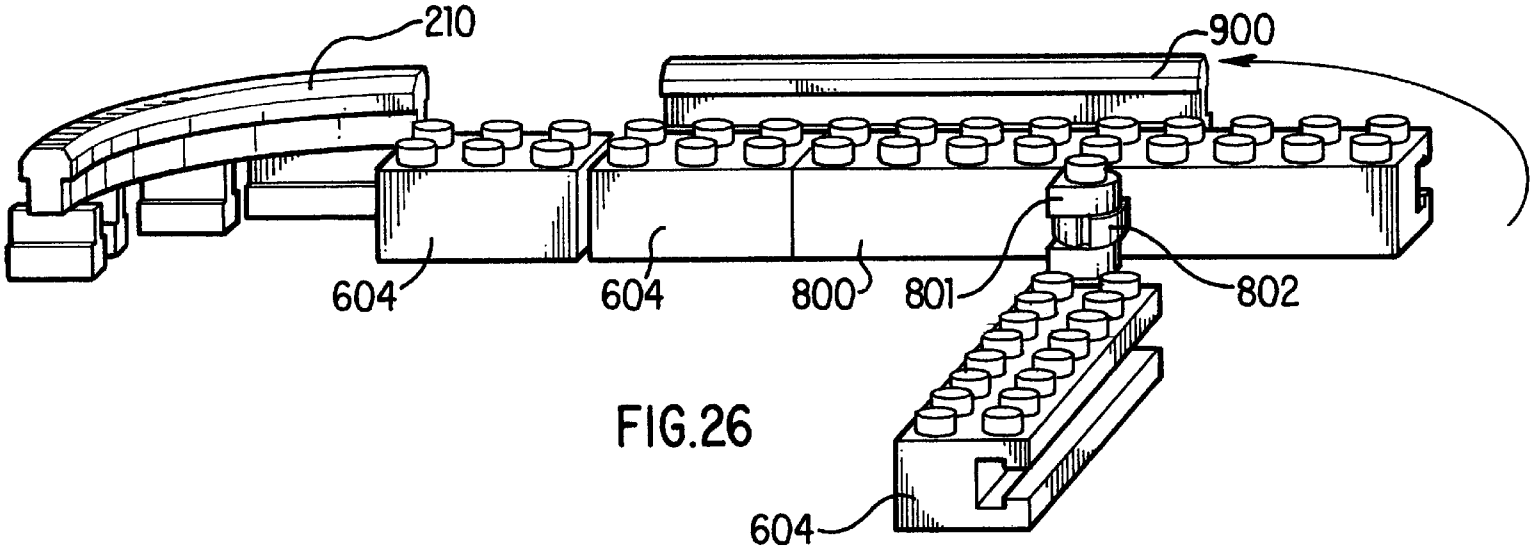
FIG. 26 shows a reflective T-rail interconnector member which has a single curved upper T-rail and a plurality of lower T-rails, and further shows a plurality of toy blocks which enable slidable, axial and pivotal motion to create a distinctive maneuverable rail system.
Figure 27:
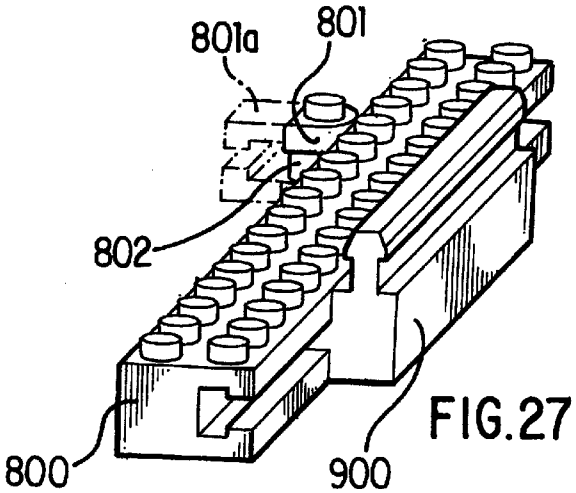
FIG. 27 shows a perspective view of the toy blocks shown in FIG. 26, illustrating details of the slidable, axial relative motion thereof.

Referring to FIGS. 26 and 27, reflective T-rail interconnector member 210 is shown here being employed in combination with toy blocks 604, which include a pair of sidewardly extended rail guides, and toy pivot block 800 which includes a pivot member 802 and sidewardly extended rail guides as shown. Pivot post member 801 serves as a pivot point mooring for toy pivot block 900. While pivot post member 801 is shown in its present form, such form is merely disclosed for illustrative purposes only and as such, an desired shape or size or configuration may be adopted without exceeding the scope of the present invention. In addition, rail guide members 801*a* may be included on pivot post member 801 if desired. Toy block 900 includes a pair of rail extension members which permit slidable axial movement of toy block 900 relative to toy pivot block 900 and toy blocks 604. Thus, as toy pivot block 900 pivotally swings about pivot post member 801, toy block 900 may simultaneously slide so as to ultimately unite with reflective T-rail interconnector member 210 so as to effect a pivotal, segment of an elongated rail system. As FIGS. 26 and 27 are merely illustrative of one particular pivot-based arrangement, any number of alternative structures may be fashioned by a user without exceeding the scope of the present invention. Likewise, while FIGS. 26 and 27 demonstrate relative motion and pivot profiles between a present invention reflective T-rail interconnector member and toy blocks, the arrows are provided for illustrative purposes only and are provided to further enhance the portrayal of relative motion and should not be construed to be either a limiting factor or an enhancing factor in terms of the scope of the present invention.

Referring back to FIGS. 1 and 2 generally, in further view of FIGS. 3 through 27, any of the present invention reflective T-rail interconnector members may be assembled with toy blocks as shown to permit three dimensional slidable interconnection with conventional toy blocks. It should be noted however, that each of the configurations shown herein by FIGS. 1 through 27 are portrayed in their present form for illustrative purposes only and may therefore encompass an infinite number of comparable shapes, dimensions and sizes and may therefore generate an infinite number of three dimensional motility profiles without exceeding the scope of the present invention. With further reference to FIG. 1, a multi-dimensional mono-rail structure is shown wherein a plurality of present invention reflective T-rail interconnector members 210 and 210*a* (which is a mirror image of reflective T-rail interconnector members 210) are interconnected with a plurality of toy blocks 600, 604 and 606 as shown. I-ramp extension members 700 are also included and are used as trestles in combination with reflective T-rail interconnector members 210 and 210*a* to create a unique multi-dimensional mono-rail for toy monorail vehicles. Referring to FIG. 2, an elongated corkscrew rail is established so as to effect a roller-coaster type of arrangement. It should therefore be understood that a roller-coaster type vehicle may be fitted for use with such a present invention arrangement without exceeding the scope of the present invention.

Obviously, numerous modifications and variations of the present invention are possible in light of the above teachings. It is therefore understood that within the scope of the appended claims, the invention may be practiced otherwise than as specifically described herein.

What is claimed is:

1. A reflective T-rail interconnector member capable of assembly in a plurality of arrangements and being capable of interconnection with toy block sets and further establishing three dimensional-movement rail systems and further permitting slidable, multi-directional motion, comprising:

(a) at least one upper T-rail having a T-shaped end-view and being extended so as to establish an elongated upright T-shaped rail, said upper T-rail being capable of slidable, axial, interconnection with toy blocks and being capable of slidable, axial interconnection with other said reflective T-rail interconnector members; and (b) at least one lower T-rail having an inverted T-shaped end-view and being extended so as to establish an elongated inverted T-shaped rail, said lower T-rail being attached to said upper T-rail wherein said lower T-rail extends non-parallel to said upper T-rail, said lower T-rail being capable of slidable, axial, interconnection with toy blocks and being capable of slidable, axial interconnection with other said reflective T-rail interconnector members, wherein at least one of said upper and lower T-rails is tapered on opposite sides.

2. The reflective T-rail interconnector member according to claim 1 wherein said reflective T-rail interconnector member has a plurality of upper T-rails and a plurality of lower T-rails, said reflective T-rail interconnector member being unistructurally molded.

3. The reflective T-rail interconnector member according to claim 1 wherein at least one of said upper and lower T-rails is straight and the other of said upper and lower T-rails is curved.

4. The reflective T-rail interconnector member according to claim 1 wherein both of said upper and lower T-rails are curved.

5. The reflective T-rail interconnector member according to claim 1 wherein said reflective T-rail interconnector member has one upper T-rail and a plurality of lower T-rails and wherein said plurality of lower T-rails extend non-parallel to one another.

6. The reflective T-rail interconnector member according to claim 1 wherein said reflective T-rail interconnector member has one upper T-rail and a plurality of lower T-rails and wherein said plurality of lower T-rails include at least one pair of lower T-rails which extend non-parallel to one another and at least one pair of lower T-rails which extend parallel to one another.

7. The reflective T-rail interconnector member according to claim 1 wherein at least one of said upper and lower T-rails includes a rack of teeth.

8. A reflective T-rail interconnector member capable of assembly in a plurality of arrangements and being capable of interconnection with toy block sets and further establishing three dimensional-movement rail systems and further permitting slidable, multi-directional motion, comprising:

(a) at least one upper T-rail having a T-shaped end-view and being extended so as to establish a T-shaped rail, said upper T-rail being capable of slidable, axial, interconnection with toy blocks and being capable of slidable, axial interconnection with other said reflective T-rail interconnector members; and (b) a plurality of lower T-rails having an inverted T-shaped end-view and being extended so as to establish inverted T-shaped rails, said lower T-rails being attached to said upper T-rail wherein said at least one pair of lower T-rails extend non-parallel to one another and wherein at least one pair of lower T-rails extend parallel to one another and wherein at least one lower T-rail extends parallel to said upper T-rail and wherein at least one of said lower T-rails extends non-parallel to said upper T-rail, said lower T-rails being capable of slidable, axial, interconnection with toy blocks and being capable of slidable, axial interconnection with other said reflective T-rail interconnector members.

9. A set of toy blocks with reflective T-rail interconnector members capable of assembly in a plurality of arrangements and being capable of interconnection with conventional toy block sets and further establishing three dimensional rail systems, comprising:

(a) at least one upper T-rail having a T-shaped end-view and being extend so as to establish a rail, said upper T-rail being capable of slidable, axial, interconnection with toy blocks and being capable of slidable, axial interconnection with other said reflective T-rail interconnector members;

(b) at least one lower T-rail having an inverted T-shaped end-view and being extend so as to establish a rail, said lower T-rail being attached to said upper T-rail wherein said lower T-rail extends non-parallel to said upper T-rail, said lower T-rail being capable of slidable, axial, interconnection with toy blocks and being capable of slidable, axial interconnection with other said reflective T-rail interconnector members;

(c) a first assortment of block configurations wherein each of said first block configurations includes a predetermined length, width and height and further includes a top, a bottom and at least four sides and includes at least one rail extension member which consists of a first thinner segment and a second wider segment adjacent to said first thinner segment, said first thinner segment having an outer dimension relative to an outer dimension of said wider segment, said thinner segment's dimension being less than said wider segment's dimension, each of said first thinner segment and said second wider segment having a length, a width and a height, each of said first thinner segment and said second wider segment having four sides wherein at least two of said thinner segment's sides are thinner relative to said wider segment's sides, each of said rail extension members extending from one of said top, bottom or sides of said first block configurations wherein at least two of each of said first thinner segment's and second wider segment's length, width and height are less than said first block configurations' length, width and height, said thinner segment being located adjacent to one of said top, bottom or sides of said first block configurations, said rail extension members having adequate size, shape and dimension so as to be capable of movable and slidable connection with a plurality of rail guide members; and (d) a second assortment of block configurations wherein each of said second block configurations includes a length, a width and a height and further includes a top, a bottom and four sides and includes at least one pair of rail guide members which consist of a first portion and a second portion, said first portion having adequate size, shape and dimension to skirt said first thinner segment and said second portion having adequate size, shape and dimension to skirt said second wider segment, each of said rail guide members extending from one of said top, bottom or sides of said second block configurations, said rail guide members having adequate size, shape and dimension so as to be capable of permitting slidable, multi-directional navigation of said rail extension members of said first block configurations therethrough.

10. The set of toy blocks with reflective T-rail interconnector members according to claim 9 wherein said second wider segment of said first assortment of block configurations is tapered on opposite sides and wherein said set of toy blocks with reflective T-rail interconnector members further comprises:

(a) a third assortment of block configurations wherein each of said third block configurations includes a length, a width and a height and further includes a top, a bottom and four sides and includes at least one pair of rail guide members which consist of a first portion and a second portion, said first portion having adequate size, shape and dimension to skirt said first thinner segment and said second portion having adequate size, shape and dimension to skirt said second wider segment, each of said rail guide members extending from one of said top, bottom or sides of said third block configurations, said rail guide members having adequate size, shape and dimension so as to be capable of permitting slidable, multi-directional navigation of said rail extension members of said first block configurations therethrough, said third block configurations further including a pivot extension member wherein said pivot extension member extends from one of said top, bottom or sides of said third block configurations, said pivot member being capable of pivotal rotation about a pivot post; and (b) at least one pivot post member.

11. The set of toy blocks with reflective T-rail interconnector members according to claim 10 wherein at least one of said first block configurations includes a curved side, said curved side having a predetermined contour, said extension member extending from said curved side and comprising the same contour as said curved side.

12. The set of toy blocks with reflective T-rail interconnector members according to claim 10 wherein at least one of said first, second and third block configurations includes at least one annular protrusion and wherein at least one of said first, second and third block configurations includes at least one annular impression and wherein said pivot post member has at least one pair of rail guide members which consist of a first portion and a second portion, said first portion having adequate size, shape and dimension to skirt said first thinner segment and said second portion having adequate size, shape and dimension to skirt said second wider segment.

13. The set of toy blocks with reflective T-rail interconnector members according to claim 9 further including at least one rail extension member which is a separate elongated I-shaped rail member capable of conveying an adequately sized and shaped vehicle thereabout, wherein said vehicle comprises at least one section defined thereon for encompassing said I-rail member and which permits said vehicle to axially traverse along said I-rail member by interlockingly and slidably connecting said vehicle to said at least one I-shaped rail member.

* * * * *